United States Patent [19]

Batts et al.

[11] 4,073,457

[45] * Feb. 14, 1978

[54] ARTICLE SUSPENSION DEVICE

[75] Inventors: John H. Batts, Grand Rapids; Everett L. Duester, Holland, both of Mich.

[73] Assignee: John Thomas Batts, Inc., Zeeland, Mich.

[ * ] Notice: The portion of the term of this patent subsequent to May 17, 1994, has been disclaimed.

[21] Appl. No.: 681,233

[22] Filed: Apr. 28, 1976

Related U.S. Application Data

[63] Continuation-in-part of Ser. No. 647,731, Jan. 9, 1976.

[51] Int. Cl.[2] ..... A44B 17/00; B42F 13/00

[52] U.S. Cl. ..... 248/340; 223/95; 248/359

[58] Field of Search ..... 223/95, 88, 87, 85; 248/340, 339, 359, 360; 211/113, 34; 24/84 B, 16 PB, 84 H

[56] References Cited

U.S. PATENT DOCUMENTS

| | | | |
|---|---|---|---|
| 1,270,811 | 7/1918 | Garant | 211/34 |
| 2,206,161 | 7/1940 | Cherne | 223/85 UX |
| 3,255,939 | 6/1966 | Buzzelli | 223/95 UX |
| 3,445,045 | 5/1969 | Panning | 223/95 |
| 3,685,189 | 8/1972 | Conger | 223/95 X |
| 3,755,859 | 9/1973 | Solari | 24/84 B |
| 3,900,181 | 8/1975 | Pitanis | 248/340 |
| 3,907,115 | 9/1975 | Satchell | 211/34 |

FOREIGN PATENT DOCUMENTS

| | | | |
|---|---|---|---|
| 1,148,048 | 5/1963 | Germany | 223/85 |

*Primary Examiner*—J. Franklin Foss

*Attorney, Agent, or Firm*—Price, Heneveld, Huizenga & Cooper

[57] ABSTRACT

A hanger for garments or other articles such as shoes having loops or web-like portions from which said articles may be suspended, includes a body member equipped with a hook, the body member being generally of U-shaped configuration when folded for use and having a central web and a pair of wings. Each of the wings defines a slot opening through one end thereof and extending generally horizontally when the hanger is suspended from its hook for engaging the loops or a web-like portion of an article. The upstanding hook is formed integral with the body member to permit suspension of the hanger from a support rod or the like.

6 Claims, 17 Drawing Figures

ARTICLE SUSPENSION DEVICE

This application is a continuation in part of application Ser. No. 647,731, filed Jan. 9, 1976.

BACKGROUND OF THE INVENTION

This invention relates to hook-supported arrangements and, more particularly, to a unique hanger for garments and other articles having web-like portions.

Heretofore, various devices have been proposed and used for the display or storage of various articles of clothing including pants, slacks and shoes. It is fairly common practice to display or store slacks or pants by using hanger-like devices having an elongated, rigid, rod-like member to which are secured clamping elements. The clamping elements engage either the bottom of the slacks or the top of the slacks and the device permits storage or display of the article of clothing from an elongated support rod. An example of one such device may be found in commonly owned U.S. Pat. No. 3,767,092 to Garrison, et al., entitled GARMENT CLAMPING HANGER WITH SLIDABLE LOCKING CLIP issued on Oct. 23, 1973. Clamping type hangers have been found to be unexceptable for use with jeans or other clothing which is fairly stiff and slippery prior to wear and repeated washings. The gripping portions of the clamps are unable to effectively grasp such articles and suspend them from a support.

Also, it has been fairly common practice to employ a more conventional hanger construction with a transversely extending pant rod. This arrangement, besides being fairly expensive for use in the storing of pants in the home or for display purposes, occasionally results in unwanted creases in the slacks or pants if they are improperly folded over the rod portion. Further, rack structures employing a plurality of spaced, parallel rods have been employed for display of pants or slacks at the retail sales level. Such a structure does not generally make efficient use of available floor space. It is not an effective display device. The structure is fairly large, presents difficulties in the removal and reinsertion of the garments due to interference between adjacent garments and, therefore, does not present the pants to the customer in the most advantageous manner.

Therefore, due to these inherent problems in the hangers heretofore employed, a need exists for a simple, inexpensive, easily mass produced hanger-type device capable of effectively suspending such garments and by which the problems heretofore experienced may be substantially alleviated.

Heretofore, various arrangements have also been proposed for the display of shoes to a retail sales customer or for the suspension of shoes in a storage area. Such arrangements have generally taken the form of shelves or rack structures attachable to a support surface or suspendable from an elongated support-type rod. Also, some elaborate, elongated wall shelf arrangements have been employed to display a pluality of shoes to a customer. These arrangements have been relatively expensive, bulky, and not readily rearrangeable to suit the available storage or display space. They have also made inefficient use of available space.

Therefore, a further need exists for a simple, easily mass produced and inexpensive item which would be readily adaptable for the suspension of a pair of shoes from a vertical support surface or from an elongated support rod. Such an arrangement would reduce the costs involved in providing for the display of shoes and the like in stores. Such reduced cost would especially be desirable in the area of large volume retailing.

SUMMARY OF THE INVENTION

In accordance with the present invention, a unique, easily manufactured device is provided for display or storage of articles of clothing having belt loops or web-like portions as in the case of shoes. Essentially, a hanger-like device is provided having a body member of generally U-shaped configuration. The body member including a central web and a pair of generally spaced, parallel, depending wings positioned on each side of the central web and defining an article receiving channel therebetween. An upstanding support engaging member is formed integral with or otherwise suitably attached to the body member for suspending the device from a support rod or the like. Each of the depending wings is bifurcated and, therefore, each defines a slot opening through one end thereof which extends generally parallel to the central web. The article to be displayed or stored is placed within the article channel and the loops or web-like portions of the article are positioned within the slots. The device is moldable as a single, generally planar part and the individual portions are foldable for use.

DETAILED DESCRIPTION OF THE PREFERRED EMBODIMENTS

Figure 1:
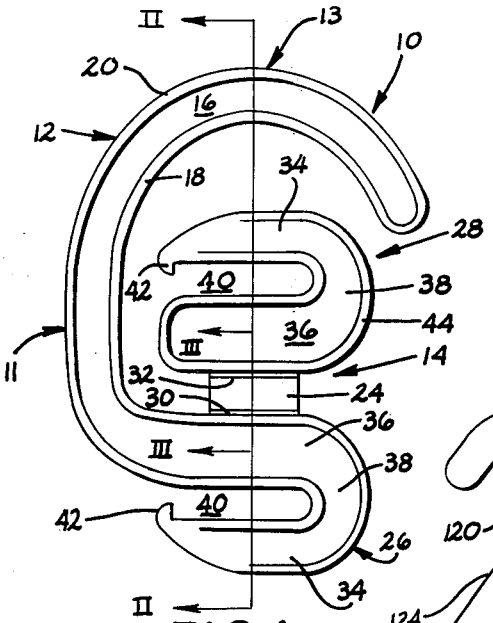
FIG. 1 is a plan view of one form of an article suspension device in accordance with the present invention in its unfolded state.

One form of an article suspension device in accordance with the present invention is illustrated in FIG. 1—5 and generally designated 10. As best seen in FIG. 1, the device 10 includes a support engaging hook portion 12 and a body portion generally designated 14. The hook portion 12 may take a variety of shapes and is shown for illustrative purposes as including a stem portion 11 and a curved portion 13. In this form, the support hook portion 12 has a generally I-beam cross section (FIG. 2) including a central web 16 and flanges 18, 20. The flanges extend along the lateral edges of the web portion 16. Flanges 18, 20, besides adding to the overall artistic design of the support hook portion, also function to reinforce this portion of the device.

Figure 2:
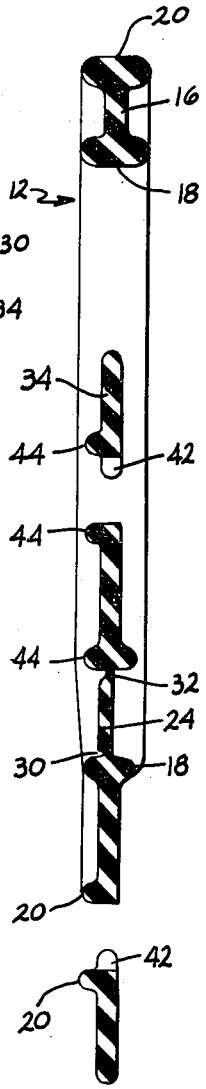
FIG. 2 is an enlarged cross-sectional view taken generally along line II—II of FIG. 1.
Figure 4:
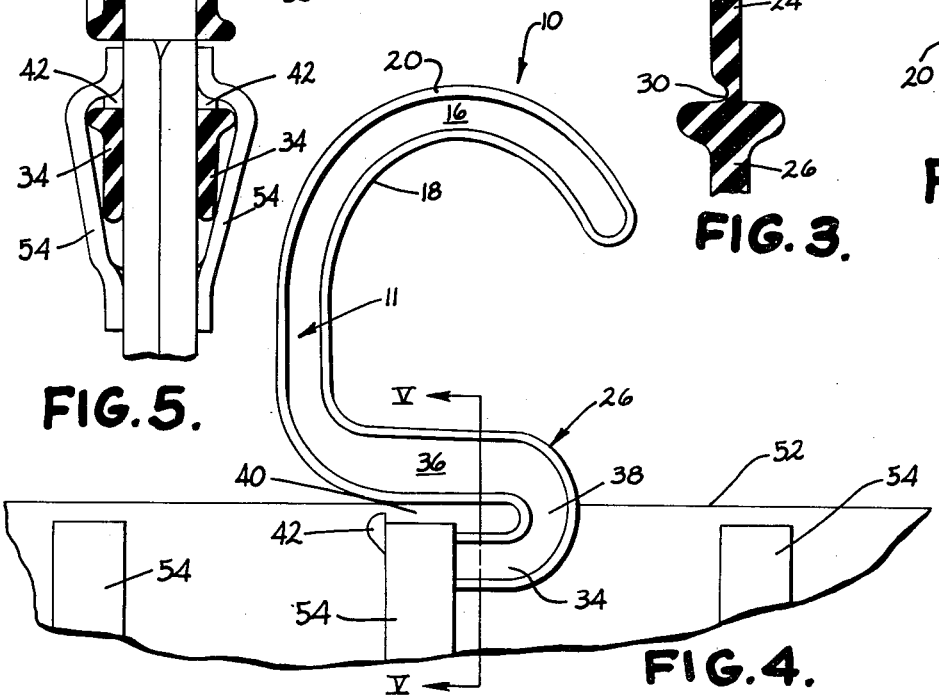
FIG. 4 is a front elevational view showing the manner in which the hanger in accordance with the present invention is employed to suspend an article of clothing which has a plurality of belt loops.
Figure 6:
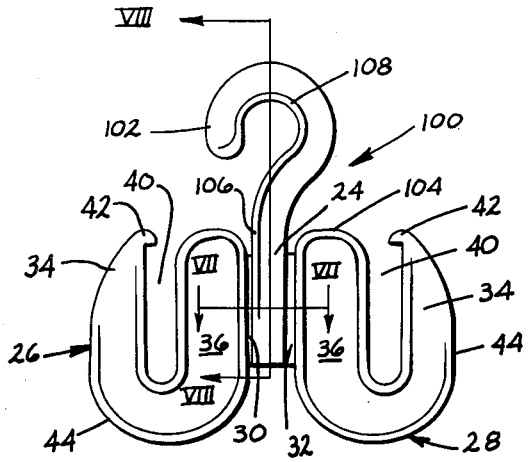
FIG. 6 is a plan view of an alternative form of an article suspension device in accordance with the present invention in its unfolded state.
Figure 7:
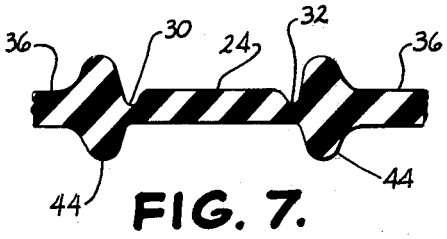
FIG. 7 is an enlarged, cross-sectional view taken generally along the line VII—VII of FIG. 6.

The body portion 14, as best seen in FIG. 1 includes a central web 24 and a pair of wing-like members 26, 28. In the preferred embodiment, the wind-like member 26 is hingedly connected along one lateral edge to the central web 24 and the central web 24 is hingedly connected or joined to the wing-like member 28 along its opposite lateral edge. The preferred manner for accomplishing this hinge-like connecton is illustrated in FIGS. 2 and 4. As shown therein, wing member 26 is hingedly joined to the central web 24 by a reduced cross-sectional portion or hinge line portion 30. The central web 24 is hingedly connected to the wing member 28 along a reduced cross sectioned portion or hinge line 32. Reduced cross sectioned portions 30, 32 are easily formed when the device is produced by conventional molding techniques. The central web 24, as will be more fully described below, serves, therefore, to space the wings and hingedly interconnect them for pivotal movement towards and away from each other.

Each wing member 26, 28 is of a bifurcated form having a generally flattened C-shaped configuration. The wing member includes a suspension leg 34 and an upper leg 36 joined by a base 38. Therefore, each wing member 26, 28 defines a loop or web receiving slot 40, opening in a direction generally perpendicular to the hook portion. The end of each suspension leg 34 adjacent the opening of the slots 40 includes an upstanding or inwardly directed tooth-like portion 42. This tooth member 42 assists in retaining the garment within the slot 40 as will be more fully described below.

With the embodiment illustrated in FIGS. 1–5, the support hook 12 is formed integral with the leg 36 of the wing member 26. Also, the flanges 18, 20 continue past the junction of these members and around substantially the entire periphery of the wing member 26. Another reinforcing flange 44 in like manner extends around substantially the entire periphery of wing member 28. The integral flanges 18, 20 and 44 increase the stiffness and rigidity of the unit. The device is therefore better able for withstanding the loads imposed upon it during use. Also, the hook 12 and wing 26 constitute, in effect, a single generally planar member.

The device 10 illustrated in FIG. 1, due to its general structural arrangement, may be mass produced as a single, flat part using conventional molding techniques and a simple two-piece mold. Since it is preferred that the hinge areas 30, 32 connecting the wings 26, 28 to the central web 24 be of an integral construction, plastic materials are preferably employed in molding the device. The material selected should have sufficient rigidity to withstand the forces imposed upon the device in use and still have sufficient flexibility to withstand repeated flexure of the hinge portions without noticeable signs of fatigue. One resinous material found to possess the desired properties to withstand repeated flexure of the hinge portions is polypropylene, such as Hercules No. 5623. It is important that the material's characteristics include a resistance to elongation or stretching at the hinge lines 30 and 32 under the normally expected operating loads. The material employed may be translucent or it may be color coordinated with the particular article of clothing suspended by the device so as not to detract from the article displayed.

Figure 5:
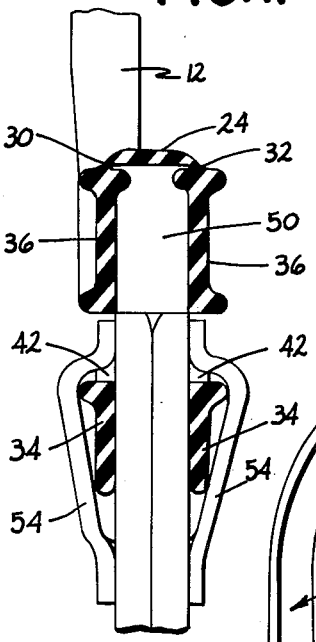
FIG. 5 is a fragmentary, enlarged cross-sectional view taken generally along line V—V of FIG. 4.

As best seen in FIGS. 4 and 5 in use, the molded article 10 is folded along the hinge lines 30, 32 so that the wings 26, 28 extend downwardly from the central web 24 in a generally parallel relatonship. In effect, the central web 24 acts as a spacing member positioned between the wings of the device. The wing members and the central web thereby define an article or garment receiving channel 50. When so positioned, the device 10 is readily adaptable for the suspension of a pair of slacks, pants or the like 52 which include a plurality of belt-receiving loops 54. The pants 52 are inserted within the channel area 50 and the loops 54 on opposite sides of the pants are placed within the slots 40 of the wing members. Preferably, the centrally positioned loops on the pants are employed for suspending the garment. The upstanding portions 42 of each wing member restrict egress from the slots 40. As seen in FIG. 4, these portions will engage the belt loops and prevent inadvertent displacement of the loops from the slots. Although illustrated as extending longitudinally in a plane generally parallel to the central web 24, the slots may be tilted slightly in a generally upward direction so that the loops 54 of the pants will be urged toward the closed end of the slot under the action of gravity. This slight tilting in conjunction with the upstanding teeth 42 will decrease the chances of inadvertent disengagement of the pants from the suspension device.

The device illustrated in FIGS. 1–5 is primarily intended for use in the display or storage of slacks. The integral hook and wing arrangements permits a plurality of such garments to be suspended transversely of a longitudinally extending support rod. This form of the invention could be used to suspend other articles such as shoes which include an upwardly extending transverse web-like portion in a manner to be more fully described below in connection with FIGS. 6–11.

An alternative form of the present invention is illustrated in FIGS. 6–11 and generally designated 100. The alternative form is similarly constructed and includes a support engaging member or hook 102 and a body member generally designated 104. The body member likewise includes a central spacer section or web portion 24 and a pair of wing members 26, 28.

As with the previous embodiment, each wing may be included at the end of each leg 34 of the wing members.

Figure 9:
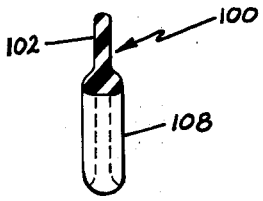
FIG. 9 is a side elevational view of the device of FIG. 6, folded for use.
Figure 9:
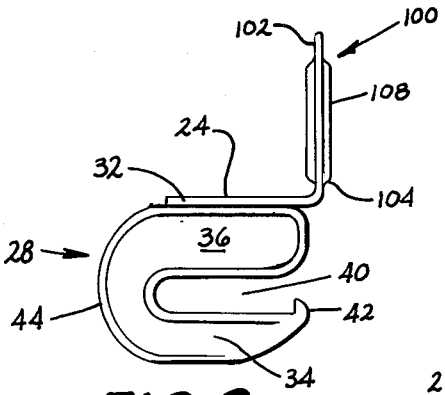
Figure 10:
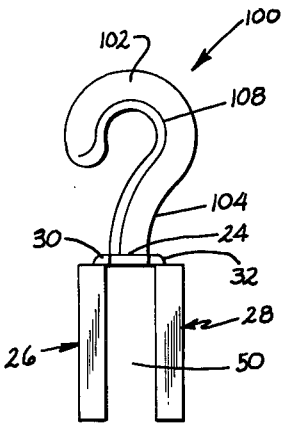
FIG. 10 is a front elevational view of the device of FIG. 9.
Figure 8:
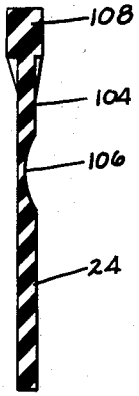
FIG. 8 is an enlarged, cross-sectional view taken generally along line VIII—VIII of FIG. 6.

As best seen in FIGS. 9 and 10, once the alternative form of the present invention has been molded, the wing members 26, 28 are easily foldable downwardly to a position where they are generally parallel to each other. The hook portion 102 in a similar manner is foldable to an erected, generally upright position in a plane perpendicular to the plane of the spacer section 24 and perpendicular to the planes of each of the wing members. As a result, the slots 40 in the wing members open in a rearward direction adjacent the support hook.

Figure 11:
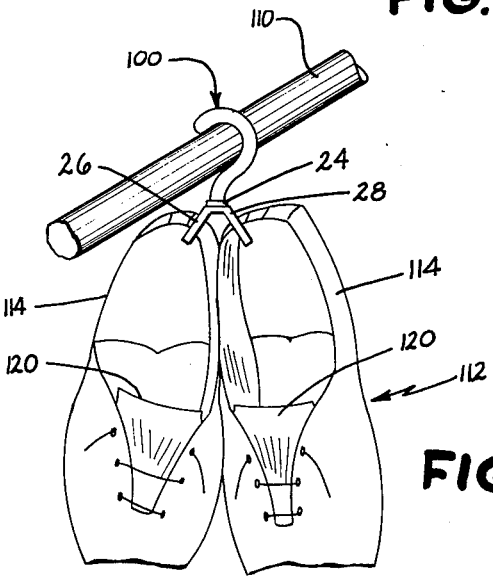
FIG. 11 is a perspective view showing the manner by which the alternative device in accordance with the present invention may be employed to suspend a pair of shoes.

As best seen in FIG. 11, the device 100 is readily adaptble for the display or storage of a pair of shoes from an elongated support rod 110. As shown, a pair of conventional shoes 112 each include an upper portion 114. The shoe upper is a generally, thin, wall-like or transverse web-like member. The area of the upper adjacent the heel portion of the shoe is readily insertable within the slots 40 of each wing member 26, 28. The wing members, as with the previously described embodiment, are pivotal toward and away from each other about the spacer section to permit easy insertion of the upper portion of each shoe within the slots.

When each shoe is so inserted into the slots, the upstanding tooth portion 42 formed on the suspension leg 34 of the wing members will engage an inner peripheral surface of this portion of the upper. As a result, the shoe under the action of gravity will tend to pivot about the tip of projection 42 and, thereby, increase the frictional contact between the shoe and the inner peripheral surfaces or spaced, parallel wall areas defined by the legs 26, 28. This arrangement thereby resists separation of the shoes from the wing members when they are suspended by the device.

In the alternative, the device 100 could be employed to suspend the shoes from the tongue or throat portions 120 of the shoes. In either case, a transverse web or wall-like portion of the shoes is engaged by one of the pair of spaced, bifurcated wings. The web-like portion of the shoe is held between the generally parallel webs and will assume a position generally perpendicular to these webs. The individual hangers or support devices 100 may then be suspended along with the shoes in a close, spaced relationship from a common support such as the support rod 110.

As with the previously described pant hanger embodiment, the shoe hanger embodiment of the present invention is an easily and relatively inexpensively mass produced item when compared with display or storage devices heretofore employed. Since the support hook 102 extends upwardly from the spacer member 24 in a plane which is substantially perpendicualr to the spacer member and the depending wings when the device is folded, a plurality of different style shoes or the same style of shoes may be supported from the common support rod. This display arrangememt therefore reduces the amount of space required for the display of a plurality of shoes. The relationship between the hook and the wings in th embodiment designated 100 is preferred for use as a shoe hanger since the shoes may be readily displayed or stored from a vertical support surface or wall. In this latter case, an individual dowel or stud-like member would be inserted into the wall and thereby extend outwardly therefrom. The hook portion 102 would then be placed over the stud thereby presenting these shoes for ready viewing by a customer. Also, this shoe hanger as with the previously described pants hanger has ready applications in the storage of shoes or other articles in the home. By employing a device in accordance with the present invention, more effective utilization of available closet space may be made by the user.

Figure 12:
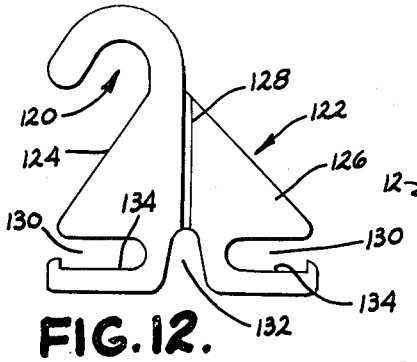
FIG. 12 is a plan view of another alternative embodiment of a suspension device in accordance with the present invention.
Figure 13:
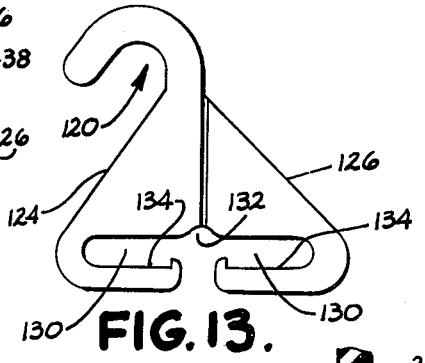
FIG. 13 is a plan view of a further alternative embodiment of a suspension device in accordance with the present invention.
Figure 3:
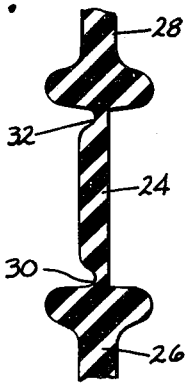
FIG. 3 is an enlarged fragmentary cross-sectional view taken generally along line III—III of FIG. 1.

Further alternative embodiments of suspension devices in accordance with the present invention are illustrated in FIGS. 12 and 13. The embodiment of FIG. 12 is similar to that of FIGS. 1–5 in that it includes a support hook 120 and a body member 122. The body member 122 has wing members 124, 126 hingedly joined along their lateral edges by an integral hinge line 128. The support hook 120 is molded integral with the wing member 124 so that these portions constitute a single planar member. The wing members 124, 126 define open ended slots 130 which are engageable with loops or web-like portions of the article to be suspended. The slots are mirror images of one another.

A recess 132 is centered about the wing elements and forms an opening extending from the side of each element towards the hook and between the slots. The depth of the slot is sufficient to create an open passage or article receiving channel between the slots. When the device of FIG. 12 is used to hang slacks from belt loops, the depth of the recess must be at least a distance greater than the spacing of the lower wall 134 of the slots from the side of the wing elements opposite the hook.

The embodiment of FIG. 13 is similar to that of FIG. 12 except slots 130 formed in wing members 124, 126 open or extend toward each other. The slot 130 in the embodiment of FIG. 13, therefore, open into or communicate with the recess 132.

When folded, these embodiments will define a generally U-shaped article receiving channel between the wing members as with the previously described embodiments. The wing members are pivotal towards and away from each other and, in use, the slots will extend in a generally horizontal plane.

The preferred construction of a device in accordance with the present invention, however, would employ a spacing web and a pair of integral hinge elements as the hinge means joining the wing members. The spacer increases the article receiving channel area and thereby increases the ease with which the device may be employed. The spacer also permits a reduction in the transverse dimension of each wing member.

Therefore, it can be seen that the unique hangers in accordance with the present invention are readily adaptable to the mass display or storage of pants and/or shoes. The device is relaively inexpensive and easily manufactured especially when compared with the more complex and bulky rack structures heretofore employed.

In either form, the hanger may be produced as a flat, one-piece part with all of the elements positioned in essentially a common plane. The wings are pivotable about the lateral edges of the central spacer so as to accommodate various size pants, shoes, shirts or any articles which are so constructed that they may be gripped by insertion in the slots of the wing members.

A further alternative embodiment of the suspension device in accordance with the present invention is illustrated in FIGS. 14–17 of the drawings and generally designated 200. The device 200 similarly includes a support engaging hook 202 and a body member 204. The body member includes a central spacer section or webbed portion 206 and a pair of wing members 208, 210. The support engaging hook 202 is joined at one end of the central spacer 206 by an integral hinge 212. Each wing member 208, 210 is joined to the lateral edges of the central spacer 206 by integral hinges 214, 216 respectively.

The wing members 208, 210 differ from those of the previously described embodiments in that they in effect clamp and thereby frictionally retain the web portions of a pair of shoes. As shown, each wing member includes the suspension leg 218 and an upper leg 220. The legs 218, 220 are configured and of a generally hook shape so as to define a rearwardly extending generally teardrop-shaped slot 222. The upper leg includes a straight or linear edge 221 and the suspension leg includes a compound curved edge 223. The slot 222 has a reduced neck area 227 dimensioned less than the thickness of the web portion of a typical shoe. The reduced neck area opens into a divergent mouth 229. The shape of the slot increases the ease with which the shoes may be engaged by each wing member.

Figure 14:
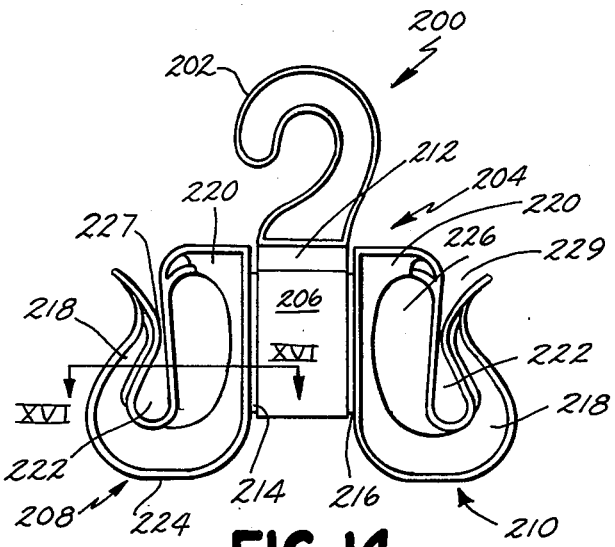
FIG. 14 is a bottom, plan view of another alternative embodiment of the device in accordance with the present invention which is primarily adapted for the suspension of a pair of shoes.
Figure 17:
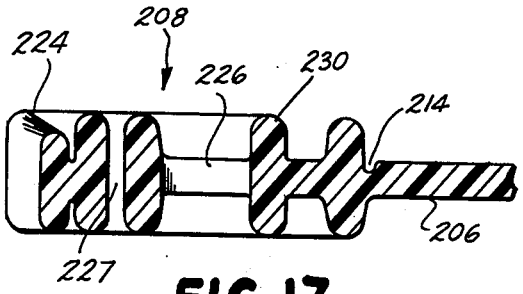
FIG. 17 is a cross-sectional view taken generally along lines XVII—XVII of FIG. 15.
Figure 15:
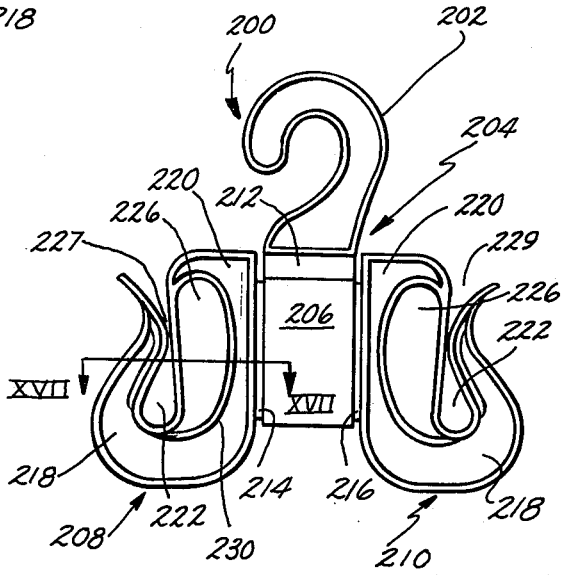
FIG. 15 is a top, plan view of the further alternative embodiment of FIG. 14.
Figure 16:
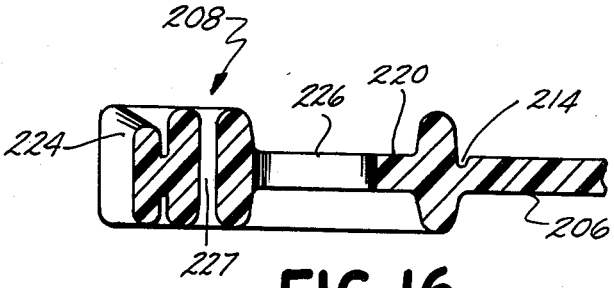
FIG. 16 is a cross-sectional view taken generally along lines XVI—XVI of FIG. 14.

Extending around the periphery of each wing member is an integrally molded reinforcing flange or rib 224. As shown in FIGS. 14 and 16, the rib 224 may extend around the entire periphery of the wing members outwardly from both the upper and lower surfaces. Also, the upper legs 220 of each wing member may define cutout portions 226. Depending upon the specific material employed, the types of shoes to be suspended and the size of the suspension device, a reinforcing rib 230 may be provided around the entire periphery of the cutout, as shown in FIGS. 15 and 17. By forming the wing members with the cutouts 226 and ribs, the amount of material required to fabricate the devices may be reduced and therefore substantial cost economies may be obtained.

As with the previous embodiments, it is preferred that this alternative device be molded from a resinous material such as polypropylene. This material is sufficiently flexible to permit repeated flexing of the hinged portions and also results in a clamping of the web portions of a shoe between the leg portions 218, 220 at the neck of the teardrop-shaped slot 222. When the web portion of each shoe is slipped into the slot, the lower leg 218 will be deflected away from leg 220 to permit passage of the web portion. The resinous material is sufficiently resilient so that the leg 218 will be biased towards leg 220. In this manner the web portion will be frictionally engaged and a more secure suspension of the pair of shoes will be obtained.

The device illustrated in FIGS. 14–17 is used in the same manner as with the alternative embodiment illustrated in FIGS. 9, 10 and 11. The wing members 208, 210 are foldable downwardly to a position where they are generally parallel to each other. The hook portion 202 is foldable to an erected, generally upright position in a plane perpendicular to the plane of the spacer section 206 and generally perpendicular to the planes of each wing member. The upper portion of each shoe is readily insertable within the slot 222. The wing members are pivotal toward and away from each other about the spacer section 206 to permit easy insertion of the upper portion of each shoe within the slots. All of the previously mentioned advantages are present with this device. However, this embodiment also results in the additional advantage of more secure retainment of the web-like portions of the shoes within the slots. It is expressly intended, therefore, that the above description should be considered as that of the preferred embodiment only. The true spirit and scope of the present invention will be determined by reference to the appended claims.

The embodiments of the invention in which an exclusive property or privilege is claimed are defined as follows:

1. An article suspending device, comprising:

a support hook;

a spacer member connected to said support hook;

a pair of wing members, each wing member being connected to a lateral edge of said spacer member and each of said wing members defining a generally tear-shaped slot having a reduced neck area and opening through one end of each of said wing members, said support hook, said spacer member and said wing members being molded from a resilient, resinous material; and first hinge means integral with an end of said spacer member and with said support hook for hingedly connecting said support hook to said spacer member and wherein said tear-shaped slots open in a direction towards said support hook.

2. An article suspending device as defined by claim 1 wherein each of said wing members includes a suspension leg and an upper leg thereby being generally hook-shaped and wherein said upper leg defines a cutout portion therein.

3. An article suspending device as defined by claim 2 wherein each of said wing members includes a reinforcing rib extending outwardly from the surface of said wing members and around the entire periphery of said wing members.

4. An article suspendng device as defined by claim 1 wherein said reduced neck of said tear-shaped slot is dimensioned less than the thickness of the article engaged therein so that said wing is deformed and thereby frictionally engages an article inserted in said slot.

5. An article suspending device as defined by claim 4 wherein each of said wing members includes a suspension leg and an upper leg each integrally joined at one end, said upper leg including a straight edge spaced from said suspension leg and said suspension leg including a compound curved lateral edge facing said straight edge to thereby define a tear-shaped slot having a reduced neck opening to a divergent mouth.

6. An article suspending device as defined by claim 5 further including:

second and third hinge means each molded integral with a respective one of wing members and a lateral edge of said spacer member for hingedly connecting said wing members to said spacer members.

* * * * *